US008636143B1

(12) United States Patent
Hebert et al.

(10) Patent No.: US 8,636,143 B1
(45) **Date of Patent: *Jan. 28, 2014**

(54) PERSONAL ITEM ORGANIZER

(75) Inventors: Nicol M. Hebert, Austin, TX (US); Marlinda O. Hinojosa, Austin, TX (US)

(73) Assignee: PAK, LLC, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/962,126

(22) Filed: Dec. 7, 2010

Related U.S. Application Data

(63) Continuation of application No. 12/388,511, filed on Feb. 18, 2009, now Pat. No. 7,854,317.

(60) Provisional application No. 61/029,554, filed on Feb. 18, 2008.

(51) Int. Cl.
*B65D 69/00* (2006.01)

(52) U.S. Cl.
USPC ..... 206/223; 206/38; 206/581; 206/823

(58) Field of Classification Search
USPC ..... 206/37, 38, 216, 223, 235, 472, 473, 206/479, 481, 581, 823; 132/308, 309, 312, 132/314, 315; 150/100, 106–108, 111–113, 150/118; 190/109, 110, 119
See application file for complete search history.

(56) References Cited

U.S. PATENT DOCUMENTS

| | | | | |
|---|---|---|---|---|
| 2,183,428 | A * | 12/1939 | McNary | 206/479 |
| 2,464,312 | A | 3/1949 | Holden | |
| 3,414,033 | A | 12/1968 | Tucker | |
| 3,963,102 | A | 6/1976 | Carp | |
| 3,964,529 | A | 6/1976 | Brod | |
| 4,177,909 | A | 12/1979 | Haskell | |
| 4,250,938 | A * | 2/1981 | Siegel | 150/111 |
| 4,532,972 | A | 8/1985 | Sinsko | |
| 4,739,809 | A * | 4/1988 | Adams | 150/112 |
| 4,991,980 | A | 2/1991 | Cohen et al. | |
| 4,995,436 | A | 2/1991 | Cantor | |
| D336,363 | S | 6/1993 | Eisenhower | |
| 5,573,109 | A * | 11/1996 | Isacson | 206/38.1 |
| 5,829,502 | A | 11/1998 | Distefano et al. | |
| 5,911,262 | A | 6/1999 | Steinhart | |
| 6,016,915 | A * | 1/2000 | Almond | 206/570 |
| 6,095,213 | A | 8/2000 | Roegner | |
| 6,109,442 | A | 8/2000 | Roegner | |
| 6,189,698 | B1 | 2/2001 | Asser | |
| 6,481,577 | B1 * | 11/2002 | Roegner | 206/581 |
| 6,561,240 | B2 | 5/2003 | Ma | |
| 6,622,856 | B2 | 9/2003 | Gallo et al. | |
| D566,393 | S | 4/2008 | Kidakarn | |
| 7,854,317 | B1 | 12/2010 | Hebert et al. | |
| 2002/0100490 | A1 * | 8/2002 | Bodwalk | 132/309 |
| 2003/0071075 | A1 * | 4/2003 | Frankenbach et al. | 222/383.1 |
| 2003/0136704 | A1 * | 7/2003 | Burgess | 206/581 |
| 2003/0209462 | A1 | 11/2003 | Godshaw et al. | |

(Continued)

*Primary Examiner* — Luan K Bui
(74) *Attorney, Agent, or Firm* — Scheinberg & Associates, PC; Michael O. Scheinberg; John B. Kelly

(57) ABSTRACT

An organization container having multiple internal compartments or straps to secure and organize personal care and hygiene items with a flap top to provide easy access to personal care and hygiene items. The organizing container can fit into different size purses or bags and be moved easily between bags, and that can stand securely on its own when outside the purse or bag.

21 Claims, 7 Drawing Sheets

(56) References Cited

U.S. PATENT DOCUMENTS

2005/0121121 A1* 6/2005 Wang ..... 150/117
2005/0161365 A1 7/2005 Karoly
2006/0042992 A1 3/2006 Vulcano
2007/0114258 A1 5/2007 Miller
2007/0292344 A1 12/2007 Turner

* cited by examiner

PERSONAL ITEM ORGANIZER

This application is a Continuation application of U.S. patent application Ser. No. 12/388,511, filed on Feb. 18, 2009, U.S. Pat. No. 7,854,317, which claims priority from U.S. Provisional Patent Application No. 61/029,554, filed Feb. 18, 2008, all of which are hereby incorporated by reference.

TECHNICAL FIELD OF THE INVENTION

The present invention relates to an improvement in carrying and organizing personal care or hygiene items and replenishing said items.

BACKGROUND OF THE INVENTION

Persons often carry personal items such as lipstick, makeup, lint brush, hair brush, tooth brush and tooth paste, finger nail clippers/manicure items, hand lotion, emergency sewing kits, tissues, and other grooming items in a container such as a purse, shoulder bag, brief case, or a suitcase when traveling locally or long distance. The purse or bag is typically composed of either one interior compartment or divided into two or three large open compartments. The personal hygiene items are generally stored in the large open compartments without any way to secure the items or organize the items. Consequently, the items become scattered throughout the compartments, making items difficult to locate, particularly smaller items. Further, the walls of the purse or bag are typically composed of non-transparent material that makes it difficult for the user to locate the personal items, particularly the larger the interior volume of the purse or handbag.

Certain items, such as hand lotion, hand sanitizer, dental floss, and other similar cosmetic items or products, necessarily need to be stored in small containers due to the limited volume of the purse or bag. As a consequence of the small volume of the containers, there is a limited amount of the product available for use. As the product becomes depleted, the user must replace not only the product, but discard the first container and replace it with another. Not only are small containers uneconomical compared to larger volumes, but also environmentally unfriendly.

Accordingly, there is a need for an organizational container that securely stores the personal care or hygiene items in a predetermined place, that allows the items to be easily located, that allows the organizer to fit into different size purses or bags and be moved easily between bags, and that can stand securely on its own when outside the purse or bag.

SUMMARY OF THE INVENTION

It is a general object of the present invention to provide a small, easily portable, organizational container.

An organization container of the present invention includes walls having multiple internal compartments or straps to secure and organize personal care and hygiene items with a flap top to provide easy access to personal care and hygiene items. The organizing container can fit into different size purses or bags and be moved easily between bags, and that can stand securely on its own when outside the purse or bag.

The foregoing has outlined rather broadly the features and technical advantages of the present invention in order that the detailed description of the invention that follows may be better understood. Additional features and advantages of the invention will be described hereinafter. It should be appreciated by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying photographs, in which.

The accompanying drawings are not intended to be drawn to scale. In the drawings, each identical or nearly identical component that is illustrated in various figures is represented by a like numeral. For purposes of clarity, not every component may be labeled in every drawing.

DETAILED DESCRIPTION OF THE PREFERRED EMBODIMENTS

Preferred embodiments of the present invention provide a small, easily portable, organizational container or pouch with of clear, opaque, or translucent walls and multiple internal compartments or straps to secure and organize personal care and hygiene items and make them easy to locate and use. Preferably embodiments have a flap top to provide easy access to the stored personal care and hygiene items. Preferred embodiments can also be easily transported between different handbags or other carrying bags but can also stand on their own when outside of a carrying bag, such as when it is placed on a flat surface, for example, a table or countertop. Specific personal care and hygiene items and bottles or other containers can be provided of an appropriate size and shape to fit into the confines of the organizational container. The bottles or other containers are also preferably re-fillable so that stores can be easily replenished. Re-fillable containers may contain, for example, hand lotion, hand cleaner, mouthwash, or dental floss. Different size containers can be offered with varying types and quantities of items so that the organizers can be better tailored to an individual user's needs.

Figure 1:
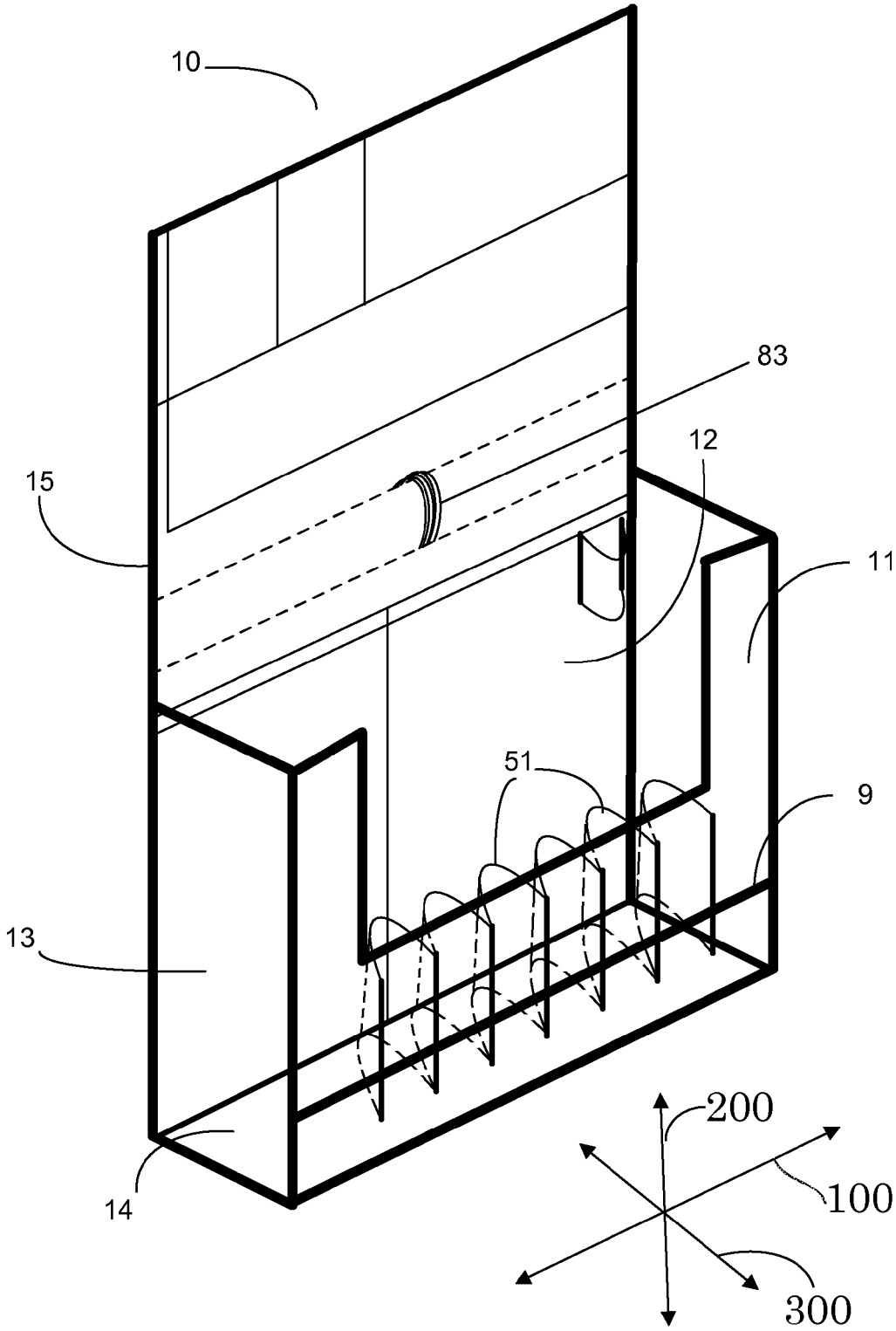
FIG. 1 shows a perspective view of an empty organizational pouch according to the present invention with the top flap raised to show the interior of the pouch.

FIG. 1 shows a perspective view of an empty organizational pouch according to the present invention with the top flap raised to show the interior of the pouch. As used herein, and shown in FIG. 1, the terms "longitudinal direction" and "lateral" are defined along the axis 100 of the organizational container. The term "transverse" is used to refer to the perpendicular axis 200 from front to back. Axis 300 is the vertical axis of the container.

Figure 2A:
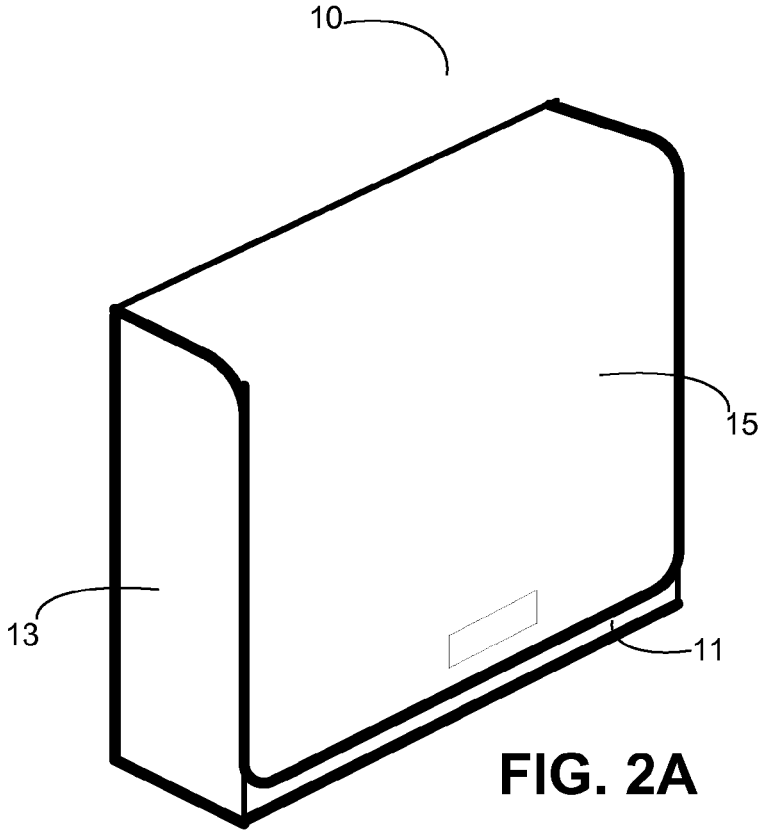
FIG. 2A shows a perspective view of an organizational pouch according to the present invention with the top flap closed.
Figure 2B:
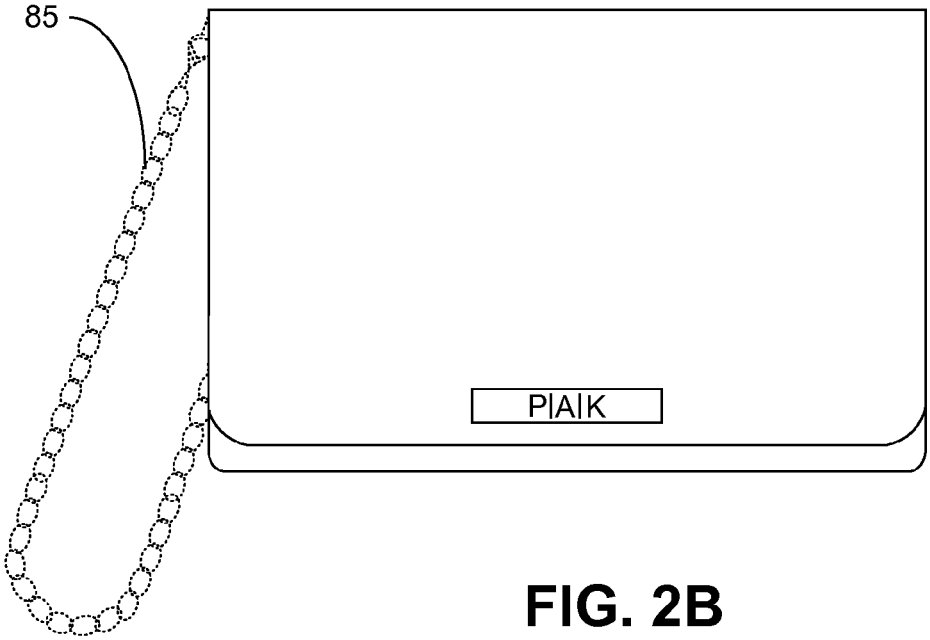
FIG. 2B shows a front view of an organizational pouch according to the present invention with the top flap closed.
Figure 3:
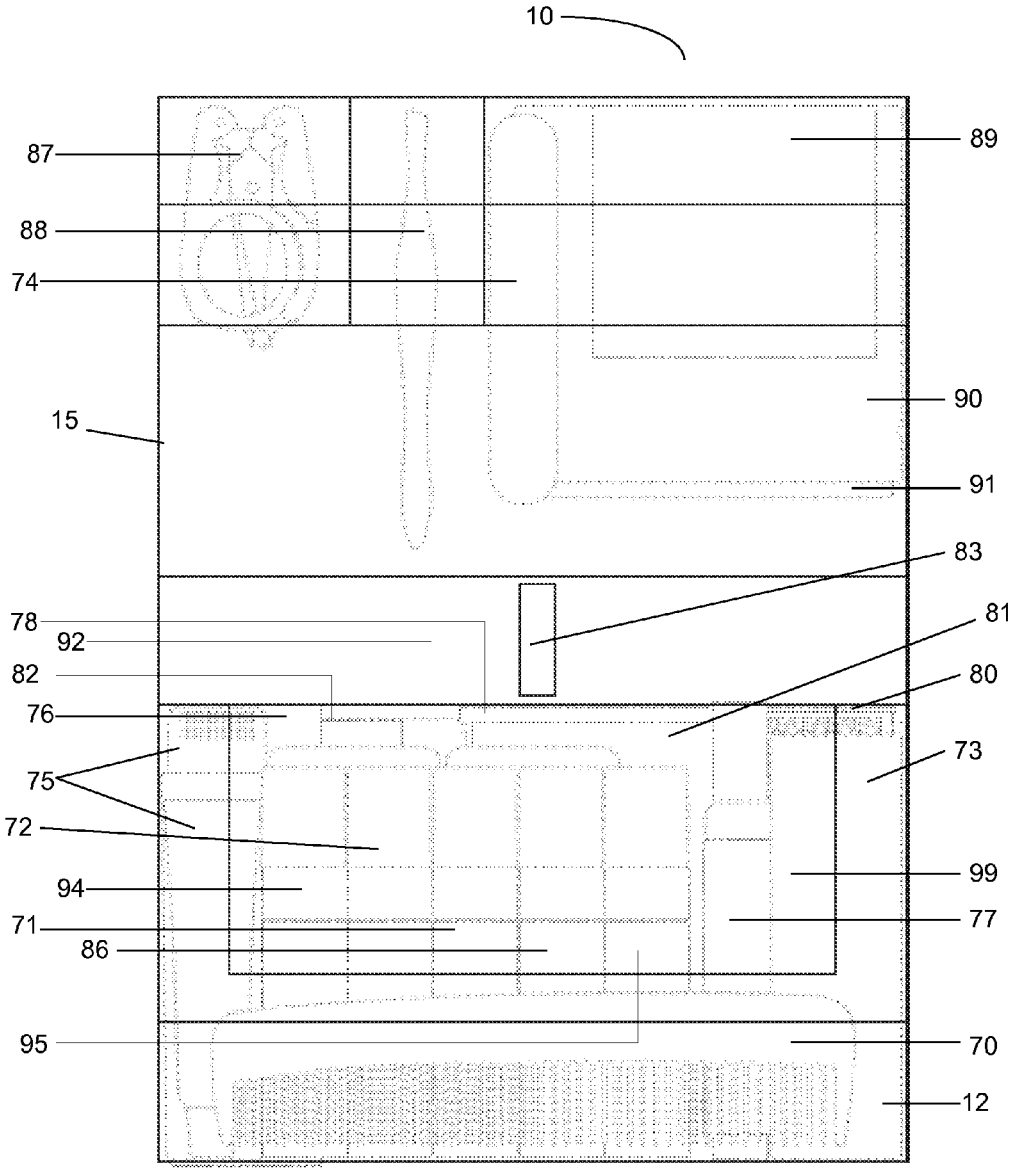
FIG. 3 shows a schematic view of an open pouch according to the present invention with the possible location of items to be placed within the pouch indicated by dashed lines.

According to a preferred embodiment of the present invention, organizational pouch 10 is constructed of front exterior extending side wall 11, back exterior extending side wall 12, which are integrally joined by the laterally and generally vertically extending end walls 13 and the laterally and generally horizontally extending bottom wall 14. Bottom wall 14 helps stabilize the organizational container when it is positioned on a flat surface outside of a purse or handbag, allowing the user to access items without the organizing container falling over, as shown in FIGS. 1, 2A, and 2B. The side faces 11 and 12 and end walls 13 are preferably generally flat. Side faces 11 and 12 are preferably parallel to each other and end walls 13 are preferably parallel to each other.

The organizational container 10 may be fabricated from a variety of now known or later developed transparent, translucent, or opaque materials that are preferably semi-rigid. Some flexibility in the outer walls is preferred to allow the container to more easily fit into larger bags and to allow a larger number of differently shaped items to be easily placed inside. Walls 11, 12, and 13 define an inner volume that can be divided into at least another sub compartment by a wall with substantially the same dimensions as the side wall 12, with the same spatial attitude as the side wall 12 (parallel to back wall 12, perpendicularly intersecting end walls 13), but placed inside the interior volume defined by the walls 11, 12 and 13. The sub compartment wall (not shown) defines a back inner compartment with side wall 12 and end walls 13. Additionally, the organizational container 10 may include a front pouch formed or attached to the exterior of side wall 11. The front pouch is shallow, preferably to retain a thin, shallow object such as a comb, has a bottom edge that is defined by the intersection of side wall 11 and bottom wall 14, and is coincident with the plane of side wall 11. The front pouch is shallow in that its height is substantially less than its longitudinal length.

In a preferred embodiment, contents of the present invention are secured to the front and rear walls by straps 51, as shown by FIG. 1. Middle compartment 40 can be formed between interior walls 16 and 17. In the present example, the middle compartment does not have restraining straps 51, but those skilled in the art will recognize that straps could also be employed in the middle compartment. Straps 51 are comprised of transparent plastic material, but those skilled in the art will recognize that the straps could be fashioned of other material, including elastic, to secure the items in an organized fashion. Other means of holding items in place such as pouches or small pockets could also be used.

In the present embodiment shown in FIG. 1, the front and back exterior extending side walls are approximately 5.5 inches laterally and 3.5 inches vertically. The end walls 13 are approximately 1 inches transversely and 3.5 inches vertically. The bottom wall 14 is approximately 1 inch transversely and 5.5 inches longitudinally. Embodiments of different sizes could be used obviously be used, with larger containers holding more or a larger variety of items.

Flap 15 extends vertically from back exterior extending side wall as shown in FIG. 1. FIG. 2A shows a perspective view of an organizational pouch according to the present invention with the top flap closed, while FIG. 2B shows a front view of an organizational pouch according to the present invention with the top flap closed. Shoulder strap 85 can be used to allow the pouch 10 to be easily carried by itself rather than inside a larger bag. In the present embodiment, a closure device employing a hook-and-loop type fastener such as Velcro® 60 can be employed as the preferred mechanism for fastening the flap 15 to front exterior side wall 12. Alternatively, other suitable known closure devices such as zipper, snaps, or conventional buttons can be employed.

Figure 4:
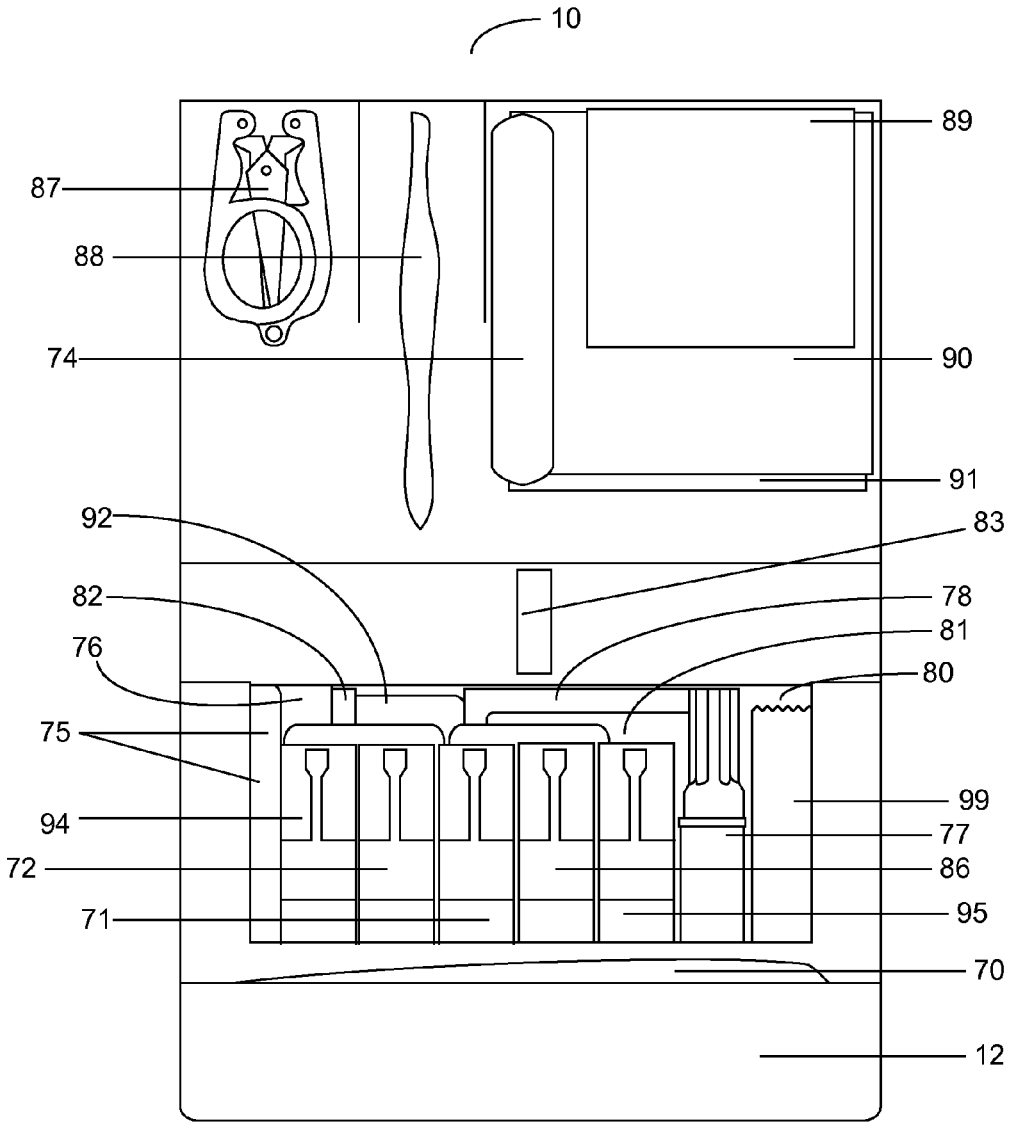
FIG. 4 shows a front view of an open organizational pouch according to the present invention filled with a variety of personal care and hygiene items.
Figure 7:
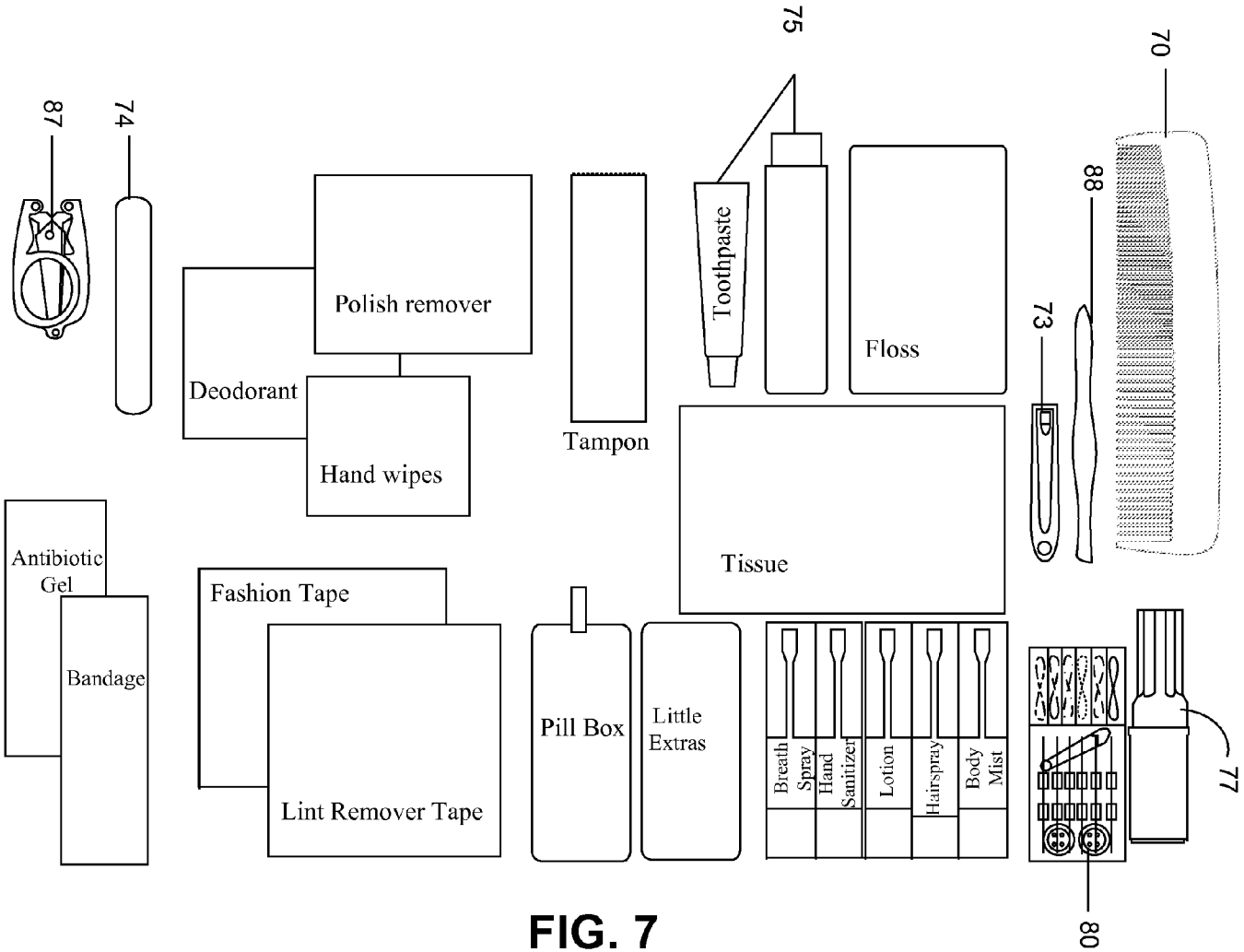
FIG. 7 shows items that could be carried in the organizer pouch of FIG. 4.

In preferred embodiments of the present invention, the personal care and hygiene items are carefully chosen to provide a user with the particular items most commonly needed in the smallest possible space. For example, in the preferred embodiment of the present invention of FIG. 4, an organizational pouch could contain the following items as shown in FIG. 7: folding scissors 87, tweezers 88, a nail file 74, a pill box to hold personal medication 78, a container for miscellaneous items, several adhesive bandages 82, a foil package of antiseptic ointment 93, a foil package of dental floss 76, a travel-type compact tooth brush 75, refillable containers of breath spray 94, hand sanitizer 84, hand lotion 71, hair spray 86, and body mist 95, wet nap moist towelettes 89, deodorant towelettes 90, nail polish remover pads 91, a package of facial tissue 97, fashion (double-sided) tape 98, lint remover tape 81, a small sewing kit 80, a tampon 99, a stain remover pen 77, and a hair comb 70. By properly arranging the items, the organizational pouch could be approximately 5.5" wide×3.5" tall×1.0" thick.

Figure 5:
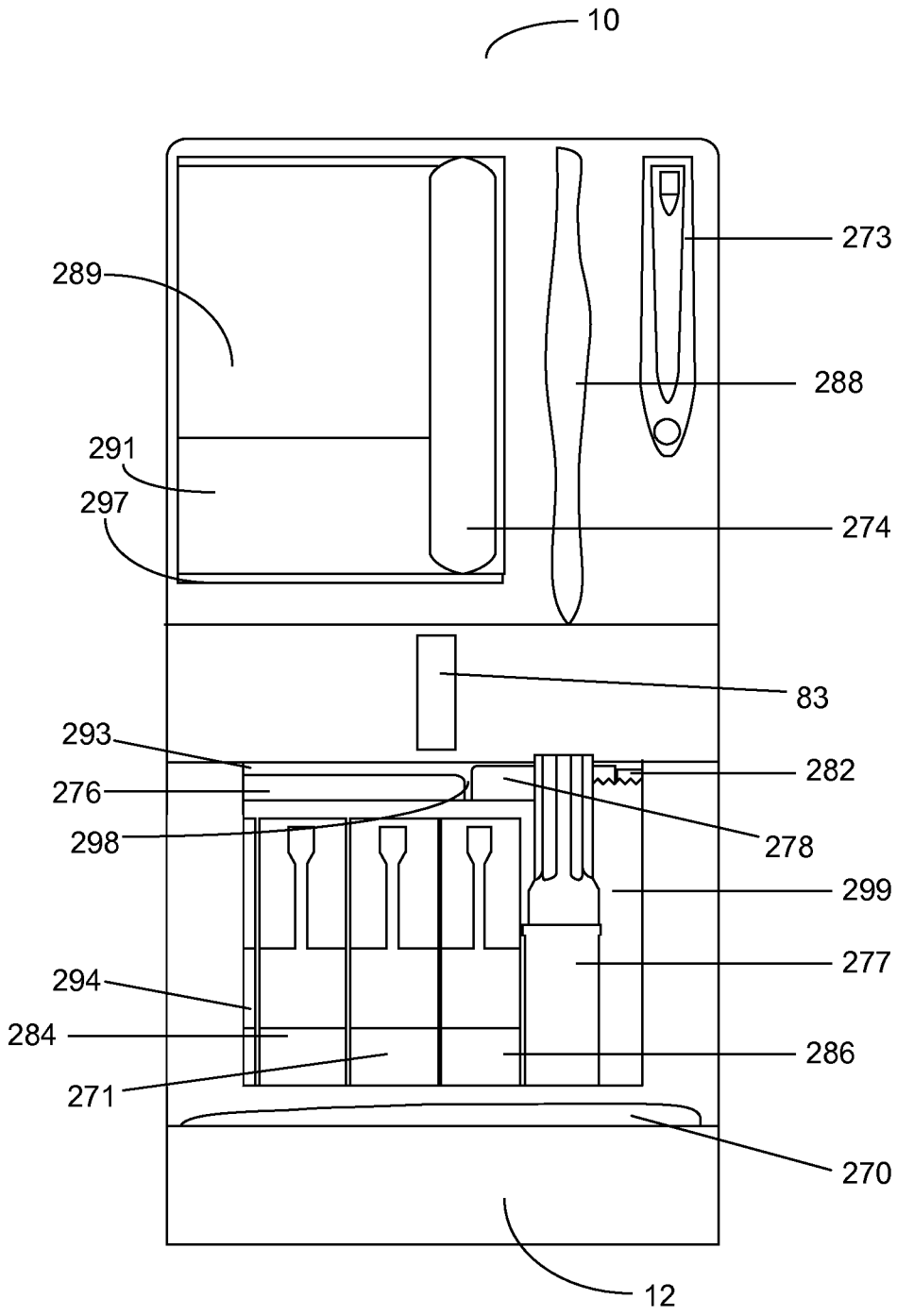
FIG. 5 shows a front view of another embodiment of an open organizational pouch according to the present invention filled with a variety of personal care and hygiene items.

In another preferred embodiment as shown in FIG. 5, a smaller organizational pouch could contain tweezers 288, a nail file 274, a pill box 278 to hold personal medication, several adhesive bandages 282, a foil package of antiseptic ointment 293, a foil package of dental floss 276, refillable containers of breath spray 294, hand sanitizer 284, hand lotion 271, and hair spray 286, wet nap moist towelettes 289, nail polish remover pads 291, a package of facial tissue 297, fashion (double-sided) tape 298, a tampon 299, a stain remover pen 277, and a hair comb 270. By properly arranging the items, the organizational pouch shown in FIG. 5 could be approximately 4.0" wide×3.5" tall×1.0" thick.

Figure 6:
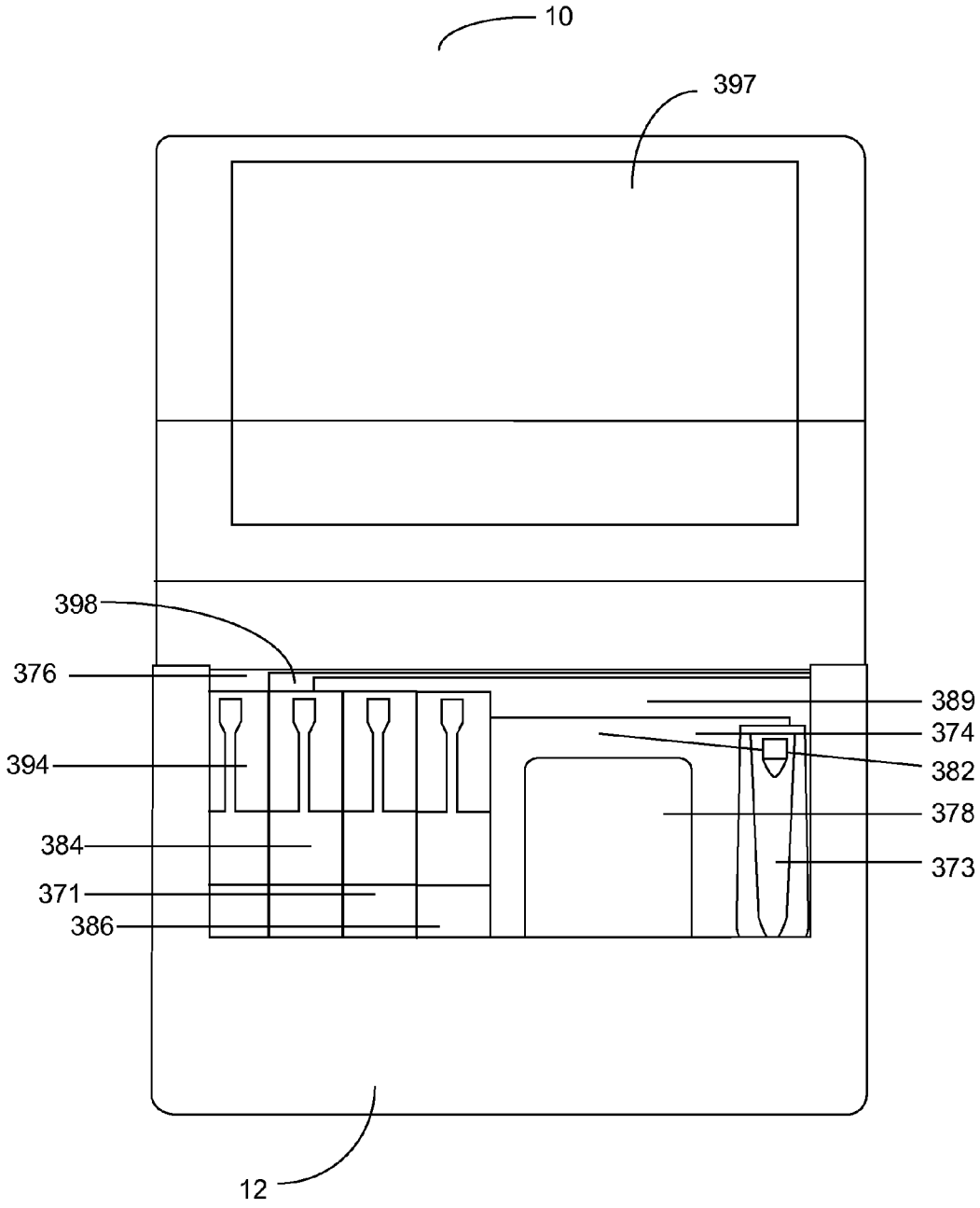
FIG. 6 shows a front view of still another embodiment of an open organizational pouch according to the present invention filled with a variety of personal care and hygiene items.

In another preferred embodiment as shown in FIG. 6, an even smaller organizational pouch could contain only a nail file 374, a pill box 378 to hold personal medication, several adhesive bandages 382, a foil package of dental floss 376, refillable containers of breath spray 389, hand sanitizer 384, hand lotion 371, and hair spray 386, wet nap moist towelettes 389, a package of facial tissue 397, and fashion (double-sided) tape 398. By properly arranging the items, the organizational pouch shown in FIG. 6 could be approximately 4.0" wide×2.5" tall×0.5" thick.

Other examples of other personal care and hygiene products that may be included in other preferred embodiments include a minor, compact folding hair brush, compact folding lint brush; refillable static remover pump; a refillable container for bandages or other first aid supplies, static remover fluid; mouth wash; a multi-purpose tool such as a LEATHERMAN®, duct tape, lipstick, makeup, bobby pins; and hair bands.

Having described several embodiments of the invention in detail, various modifications and improvements will readily occur to those skilled in the art. Such modifications and improvements are intended to be within the scope of the invention. Accordingly, the foregoing description is by way of example only, and is not intended as limiting.

Although the present invention and its advantages have been described in detail, it should be understood that various changes, substitutions and alterations can be made herein without departing from the spirit and scope of the invention as defined by the claims. Because the invention can be used in different applications for different purposes, not every embodiment falling within the scope of the attached claims will achieve every objective. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the claims are intended to include within their scope such processes, machines, manufacture, compositions of matter, means, methods, or steps.

We claim as follows:

1. An organization container, comprising:

a) a plurality of hygiene products, including:
- a mirror;
- a fingernail file;
- dental floss;
- breath spray;
- hair spray;
- bandages;
- adhesive tape;
- moist towelette;
- at least one empty container suitable for holding pills, a volume of liquid, or other small objects; and b) an inner volume having a plurality of compartments, wherein the hygiene products are secured and organized within the plurality of compartments.

2. The organizational container of claim 1 further comprising a flat bottom allowing the organization container to stand upright on a surface.

3. The organizational container of claim 2 in which the organizational container has a plurality of outer walls including generally parallel front and back walls, and generally parallel sidewalls, said front and back walls, sidewalls, and said flat bottom defining the inner volume.

4. The organizational container of claim 2 further comprising a flap top to provide easy access to the plurality of hygiene products.

5. The organizational container of claim 4 in which said flap top extends from the back wall to fold over the top and front of the container when closed and which extends vertically from back wall to expose the inner volume of the container when the flap is opened.

6. The organizational container of claim 5 in which the outer walls are flexible.

7. The organizational container of claim 1 further comprising a plurality of straps, each strap attached to the interior of an outer wall, and wherein the hygiene products are secured and organized within the inner volume.

8. The organizational container of claim 7 in which said plurality of straps comprises a plurality of straps formed from a transparent plastic material.

9. The organizational container of claim 7 in which said plurality of straps comprises a plurality of elastic straps.

10. The organizational container of claim 7 in which said compartments have at least one compartment wall and in which each of the products in said plurality of hygiene products is held in place by a strap or by a compartment wall.

11. The organizational container of claim 1 in which the organizational container has dimensions no larger than 4.0" wide×2.5" tall×0.5" thick.

12. The organization container of claim 1, in which the plurality of hygiene products further comprises:
- a hair comb;
- moisturizing lotion;
- hand sanitizer;
- a tampon; and
- facial tissue.

13. The organization container of claim 12, in which the plurality of hygiene products further comprises:
- nail polish remover;
- antiseptic or antibacterial ointment; and
- tweezers.

14. The organizational container of claim 13 in which the organizational container has dimensions no larger than 4.0" wide×3.5" tall×1.0" thick.

15. The organization container of claim 1, further comprising a member selected from the group consisting of:
- a sewing kit;
- static remover fluid;
- a compact folding hair brush;
- a compact folding lint brush;
- a refillable container for first aid supplies;
- a multi-purpose tool;
- duct tape;
- bobby pins;
- hair bands;
- mouthwash;
- lipstick; and
- a refillable makeup container.

16. The organization container of claim 1 in which the at least one empty container suitable includes at least two refillable containers, each containing hand lotion, hand cleaner, or mouthwash.

17. An organization container, comprising:

a) a plurality of hygiene products, including:
- a mirror;
- a fingernail file;
- dental floss;
- breath spray;
- hair spray;
- bandages;
- adhesive tape;
- moist towelette;
- body mist spray;
- lint remover tape;
- collapsible scissors;
- deodorant;
- nail clippers;
- toothbrush;
- toothpaste;
- at least one empty container suitable for holding pills, a volume of liquid, or other small objects; and b) an inner volume having a plurality of compartments, wherein the hygiene products are secured and organized within the plurality of compartments.

18. The organizational container of claim 17 in which the organizational container has a plurality of outer walls including:
- generally parallel front and back walls;
- generally parallel sidewalls;
- a flat bottom;
- said front and back walls, sidewalls, and said flat bottom defining the inner volume, and said flat bottom allowing the organization container to stand upright on a surface.

19. The organizational container of claim 18 further comprising a plurality of straps, each strap attached to the interior of an outer wall, and each strap holding at least one of the products in said plurality of hygiene products in place within the inner volume.

20. The organizational container of claim 19 in which said compartments have at least one compartment wall and in which each of the products in said plurality of hygiene products is held in place by a strap or by a compartment wall.

21. The organizational container of claim 17 in which the organizational container has dimensions no larger than 5.5" wide and 3.5" tall.

* * * * *